United States Patent [19]

Ackermann et al.

[11] Patent Number: 4,906,963

[45] Date of Patent: Mar. 6, 1990

[54] EXTERNALLY MOUNTED BLOWN FUSE INDICATOR

[75] Inventors: Rainer Ackermann, El Paso, Tex.; Jerry L. Mosesian, Newburyport, Mass.; Edward J. Knapp, Jr., Stratham, N.H.

[73] Assignee: Gould, Inc., Rolling Meadows, Ill.

[21] Appl. No.: 317,712

[22] Filed: Mar. 1, 1989

[51] Int. Cl.[4] ..... H01H 85/30

[52] U.S. Cl. ..... 337/244; 337/241; 337/267

[58] Field of Search ..... 337/241, 244, 245, 265, 337/267, 209

[56] References Cited

U.S. PATENT DOCUMENTS

| | | | |
|---|---|---|---|
| 3,535,668 | 10/1970 | Cinquin | 337/244 |
| 3,593,246 | 7/1971 | Ferraz | 337/5 |
| 4,387,358 | 6/1983 | Knapp, Jr. | 337/244 |

*Primary Examiner*—H. Broome

*Attorney, Agent, or Firm*—Fish & Richardson

[57] ABSTRACT

A spring loaded blown fuse indicator is provided that is adapted to be mounted directly on the side of an electric fuse in parallel with the fuse current path.

The indicator provides an indicating pin that extends perpendicular to the longitudinal axis of the fuse. The indicator body comprises two identical molded halves which facilitate assembly and allow the indicator restraining wire to be readily encapsulated in an arc-quenching epoxy adhesive.

14 Claims, 2 Drawing Sheets

EXTERNALLY MOUNTED BLOWN FUSE INDICATOR

BACKGROUND OF THE INVENTION

1. Field of the Invention

The present invention relates to indicators for denoting the condition of an electric fuse. More specifically it relates to an indicator which is mounted on the outside of the fuse in parallel with the current path of the fuse.

2. Description of the Prior Art

A well-known type of current limiting fuse comprises a housing of insulating material having opposite ends closed by a metal cap or ferrule, commonly referred to as an end terminal. At least one fusible element extends through the housing and is electrically conductively connected to the end terminals. During normal current conditions, the fusible elements remain intact. When certain abnormal current conditions occur, the fusible element melts and interrupts the flow of current through the circuit the fuse is protecting. Arcing normally occurs during the normal interruption operation of a fuse and for this reason the housing is usually filled with a granular arc-quenching filler such as sand.

When a fuse has operated in response to abnormal circuit conditions, to successfully interrupt a circuit, there is normally no obvious change in the outward appearance of the fuse. For that reason, many fuses currently in use are provided with an indicator which is designed to operate when the fuse operates to provide a visual or otherwise a ascertainable indication that the fuse has opened.

Some examples of fuses having indicators are shown in U.S. Pat. Nos. 3,535,668, 3,593,246, 3,601,739 and 4,023,133. Such indicators are normally retained in a retracted position, against the force of a spring, by a restraining wire. The restraining wire usually extends throughout the length of the fuse casing and is in electrical contact with the terminals at the opposite ends thereof.

When a fuse is operating under normal conditions, the indicator wire does not conduct a significant current flow because it has a higher ohmic resistance than the fusible elements. When the fusible elements have blown, the restraining wire conducts current momentarily until it likewise melts or fuses thereby releasing the indicator and allowing the spring to move it into a position signifying that the fuse has blown.

Another type of blown-fuse indicator is shown in U.S. Pat. Nos. 3,179,774 and 3,621,431. These indicators have the appearance of a fuse but actually contain a spring loaded indicator pin normally restrained by a restraining wire. They are meant to be wired in parallel with the fuse being monitored. Often this type of indicator is mounted remote from the fuse.

It is an object of the present invention to provide a blown fuse indicator which may be optionally attached to appropriate mounting tabs on the side of an electric fuse.

It is another object of this invention to provide an externally mounted blown fuse indicator which does not require compromising the structural integrity of the fuse casing.

A related object is to provide an externally mounted blown fuse indicator which has an indicating pin that extends perpendicular to the longitudinal axis of the fuse.

It is a further object of the resent invention is to provide a simple, low cost, reliable blown fuse indicator.

SUMMARY OF THE INVENTION

The present invention relates to a blown fuse indicator adapted to be attached to the exterior of an electric fuse. The indicator includes a body made from a rigid electrically insulating material. A pair of spaced apart conductive terminals are attached to the body, which, in turn, serve to attach the indicator to a fuse. The body has an indicator wire path therein which extends between the pair of conductive terminals.

An indicator restraining wire is tightly drawn along the indicator wire path and is electrically conductively connected at opposite ends to the pair of conductive terminals. A spring biased indicating means is carried by the body at a location along the indicator wire path. A section of the tightly drawn indicator restraining wire engages a portion of the indicating means and holds it against its spring in a not blown condition. Except for the section which engages the indicating means the indicator restraining wire is substantially completely encapsulated by an arc quenching material, preferably an epoxy adhesive.

BRIEF DESCRIPTION OF THE DRAWING

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts and wherein:

DESCRIPTION OF THE PREFERRED EMBODIMENTS

Figure 1:
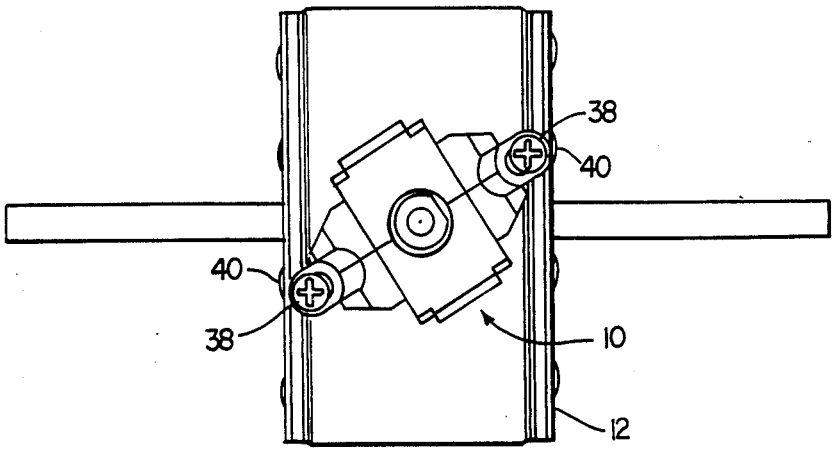
FIG. 1 is plan view of a blown fuse indicator according to the present invention operatively mounted on an electric fuse.
Figure 2:
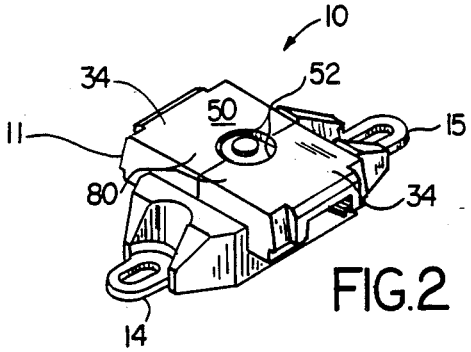
FIG. 2 is perspective view of the blown fuse indicator of the present invention.
Figure 3:
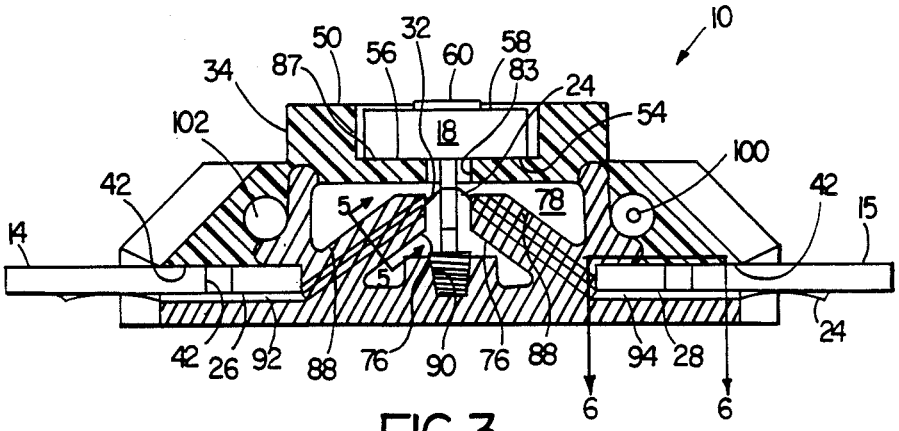
FIG. 3 is a side view of one half of the indicator of FIG. 2 showing all operative components thereof.

With reference to FIGS. 1, 2 and 3, reference numeral 10 refers to a spring loaded blown fuse indicator. In FIG. 1 the indicator 10 is shown operably mounted to the side of an electric fuse 12. The fuse shown is an extremely fast acting type which is designed to provide protection for diodes, thyristors, triacs and other solid state components and devices.

The indicator 10 includes a body 11, which supports a pair of spaced apart conductive terminals 14, 15. A spring biased indicating assembly 16 is made up of an indicator head 18, an indicator head support pin 20 and an indicator biasing spring 22. With reference to FIG. 3 it will be seen that an indicator restraining wire 24 extends from a first electrical connection 26 to one of the conductive terminals 14 to a second electrical connection 28 to the other of the conductive terminals 15. The path of the indicator restraining wire 24, which will be described in detail below, passes through a slot 30 in the indicator head support pin 20 thereby holding the spring biased indicating assembly 16 against the force of its compressed spring 22 in the "not blown" position shown in the drawings. With the exception of the section 32 of the indicator restraining wire 24 in the region of the support pin 20, the entire length of the restraining wire 24 is encapsulated in an arc quenching medium.

Still referring to FIGS. 1, 2 and 3, it will be seen that the indicator body 11 is made up of two identical body halves 34 which are made from a suitable structurally rigid insulating material. In the preferred embodiment the body halves 34 are injection molded from a 10% glass filled polycarbonate thermosetting resin.

Figure 6:
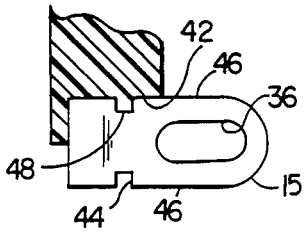
FIG. 6 is a fragmentary cross-sectional view taken along the line 6—6 in FIG. 3.

FIG. 3 shows one of the body halves 34 with all components operatively mounted therein. The conductive terminals 14, 15 are planar blades stamped from a cartridge brass alloy and plated with, first tin, and then, a finish of pyrophosphate copper plating. As best seen in FIG. 6, each blade has a slotted opening 36 therein that receives mounting screws 38 (see FIG. 1) to attach the indicator to tabs 40 provided on a fuse 12. The other end of the blades is adapted to be received in mating slots 42 formed in the body halves 34. Notches 44 are provided in the longitudinal edges 46 of the blades. The notches 44 engage mating projections 48 formed in the slots 42 to thereby lock the blade terminals in place when the two halves are assembled together.

With continued reference to FIGS. 1, 2 and 3, each body half 34 has a planar upper surface 50 in which is molded a recess 52 having a semicircular cross-section. The recesses 52 cooperate to define a cylindrical shaped recess for receiving and supporting the indicator head 18. The indicator head 18 is generally cylindrical in shape and has a flat lower surface 54 which engages a parallel flat surface 56 which defines the bottom of the indicator head receiving recess when the indicator is in the "not blown" condition, as in FIG. 3. The upper surface 58 of the indicator head 18 is generally flat and includes a small protuberance 60 which, as will be described below, facilitates activation of a mechanical switch which may be added to the indicator 10. The head, as are the body halves, preferably is injection molded from a 10% glass filled thermosetting polycarbonate resin. The body is preferably black while the indicating head 18 is preferably red to enhance its visibility.

Figure 4:
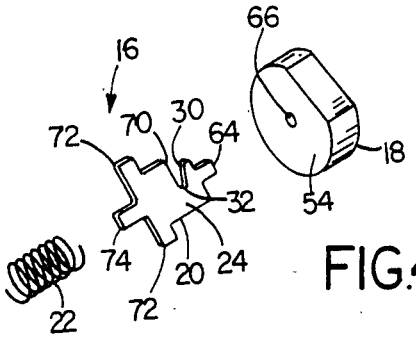
FIG. 4 is an exploded perspective showing of the indicator means of the indicator of FIG. 2.

Looking now at FIGS. 3 and 4, the indicator head support pin 20 is formed from a suitable sheet material, in the preferred embodiment it is stamped from a sheet of cartridge brass alloy. The upper end of the support pin 20 defines an upwardly extending leg 64 which is adapted to be tightly received in a dead end opening 66 provided in the bottom of the indicator head 18. In the preferred embodiment the leg 64 of pin 20 is press fit into the opening 66 and is also adhesively attached thereto. As mentioned above, spaced downwardly from the leg 64 is a substantially horizontally disposed slot 30. The slot 30 includes an upwardly facing indicator wire engaging edge 70. Spaced downwardly from the slot 30 are a pair of laterally extending legs 72 which, when the pin is installed in the indicator body, and the indicator has "blown," serve to retain the indicator assembly 16 within the body. Finally, the pin 20 has a downwardly extending bottom leg 74, which assists in positioning and retaining the indicator biasing spring 22.

Turning now to FIG. 3 the structural details of the interior of the body halves 34 and the assembly of the indicator will be described. This view shows the indicator fully assembled in one body half and in condition for the second body half to be added to complete the assembly.

Figure 5:
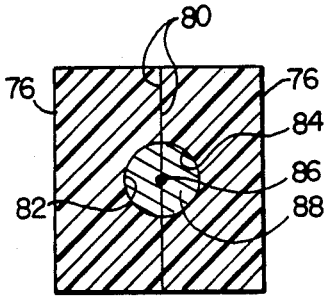
FIG. 5 is a fragmentary cross-sectional view taken along the line 5—5 in FIG. 3.

As mentioned hereinabove the indicator restraining wire 24 follows a predetermined path from one of the terminals 14 to the other 15. The restraining wire path is defined by the pair of angularly positioned wall-like projections 76 formed within an interior chamber 78 within the body halves 34. With additional reference to FIG. 5 it will be seen that the confronting faces 80 of each of the projections 76 is provided with a semicircular channel 82 therein, each of which extends from one of the terminals 14, 15 to a location within the chamber 78 underlying an opening 83 in the chamber upper wall 87 which communicates with the indicator head receiving recess 52, 52. The channels 82, when the indicator is assembled define a pair of elongated cylindrical passageways 84 having a cross-section substantially larger than that of the indicator wire 24.

Further, when assembled, the portions 86 of the indicator restraining wire 24 which pass through the passageways 84 are completely encapsulated by an arc-quenching medium 88 which fills the remaining volume of the passageway 84. In the preferred embodiment the arc-quenching medium is a cured epoxy adhesive. A two-part epoxy capable of curing at room temperature, having a worklife of about 10 minutes has been successfully used.

A brief description of the method of assembling the indicator 10 will further facilitate a complete understanding of the invention. The first step is to assemble the indicator head support pin 20 to the indicator head 18. The upper leg 64 of the pin is press fit into the opening 66 in the head. A small amount of a cyanoacrylate glue is then added to the connection. Next, one body half is supported in a appropriate fixture and the two blade terminals 14, 15 are pressed into the slots 42 in the body half.

Following this, a spring 22 is placed on the lower leg 74 of the pin 20. The spring is then inserted into a spring receiving well 90 provided at the bottom of the interior chamber 78. The indicator is then held down against the force of the spring 22 with the bottom 54 of the indicating head seated within the head receiving recess 52, 52. A suitable vise or clamp holds the head in this position.

The indicator restraining wire 24 is then passed into the slot 30 in the head support pin 20. The ends of the wire are drawn tightly downwardly into the terminal retaining slots 42 underneath the two terminals 14 and 15 as at 92, 94. The slots 42 are provided with a slight taper to assure that the wire may be drawn into the slot and be firmly clamped against the blade. This forms both the mechanical and electrical connection of the wire ends. A drop of cyanoacrylate adhesive on each connection assures positive retention. In the preferred embodiment the indicator restraining wire 24 is a phosphor bronze alloy wire having a diameter of 0.0037 inches. This wire has been found to have sufficient tensile strength to withstand the forces expected to be imparted by the spring 22, as well as having electrical characteristics which allow the indicator to trip on as low as 1 volt on up to the rated voltage of fuses with which it is used, typically 660 volts.

Following this, the epoxy resin that forms the arc-quenching medium 88 is applied. With reference to FIG. 3 the region where the epoxy is applied is cross hatched as a synthetic resin. Application to this area assures proper encapsulation of the wire 24 while also assuring that the cured epoxy will not interfere with the mechanical operation of the indicator when the wire 24 fuses. Following this the second body half 34 is pressed into engagement with the half containing the indicator assembly 16. The thus assembled indicator is then clamped together to allow the epoxy to cure. With reference to FIG. 3 alignment and assembly of the body halves 34 to one another is facilitated by mating alignment pins 100 and pin receiving openings 102 provided in the confronting walls. Since the body halves are identical it is readily apparent how the pins cooperate upon assembly.

Figure 7:
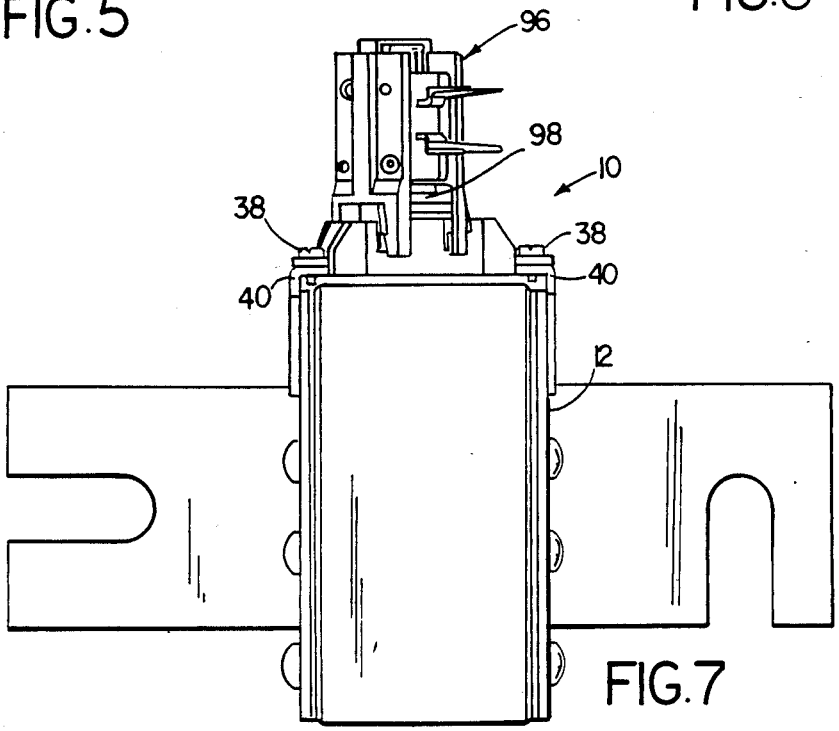
FIG. 7 is a simplified showing of an indicator/fuse assembly with an indicator actuated switch added thereto.

FIG. 7 shows an indicator 10 mounted on a fuse 12. In turn mounted on the indicator 10 is mechanical switch 96 which is adapted to be actuated by the action of the indicating assembly 16. It will be seen that reference numeral 98 identifies the indicator head which has been extended, upon melting of the indicator restraining wire, and acted upon by the spring 22 to contact and actuate the switch. Such add on switches are common in the art and no further detail will be set forth herein. It should be appreciated that the molded body of the indicator is configured to readily receive such a switch.

This invention may be practiced or embodied in still other ways without departing from the spirit or essential character thereof. The preferred embodiment described herein is therefore illustrative and not restrictive, the scope of the invention being indicated by the appended claims and all variations which come within the meaning of the claims are intended to be embraced therein.

What is claimed is:

1. A blown fuse indicator to be attached to the exterior of an electric fuse comprising:

(a) a rigid electrically insulating body;

(b) a pair of spaced apart conductive terminal means, supported by said body, for attaching the indicator to a fuse;

(c) a predetermined path within said body extending from one of said conductive terminal means to the other of said conductive terminal means;

(d) an indicator restraining wire having one end electrically conductively connected to one of said conductive terminal means and being tightly drawn along said predetermined path, the other end of said wire being electrically conductively connected to the other of said conductive terminal means;

(e) a spring biased indicating means carried by said body at a location along said predetermined path of said indicator restraining wire, a section of said tightly drawn indicator restraining wire operatively engaging a portion of said indicating means and holding said indicating means in a "not blown" condition;

(f) arc-quenching means for substantially completely encapsulating substantially all of said indicator restraining wire except said section which engages a portion of said indicating means.

2. The apparatus of claim 1 wherein said predetermined path comprises a pair of internal passageways formed in said body, one of said passageways having a first-end located immediately adjacent a portion of one of said conductive terminal means and, the other of said passageways having a first-end located immediately adjacent a portion of the other of said conductive terminal means; the other ends of said pair of passageways being located in spaced apart confronting relationship with one another, defining a space there between; said section of said indicator wire which engages said indicating means passing through said space.

3. The apparatus of claim 2 wherein both of said pair of internal passageways are filled with an epoxy resin to affect said encapsulation thereof.

4. The apparatus of claim 1 wherein said body comprises two halves, each half comprising a substantially identical molded part.

5. The apparatus of claim 4 wherein said body halves are injection molded from a glass filled polycarbonate resin.

6. The apparatus of claim 4 wherein each of said body halves includes a pair of spaced apart means for receiving and retaining said pair of conductive terminals.

7. The apparatus of claim 6 wherein said terminal means comprise substantially planar sections having notches in opposing edges thereof and wherein each of said body halves has a terminal means receiving slot therein, each of said slots having a terminal means retaining projection therein configured to mate with and positively retain said terminal means in said slots when said body halves are joined.

8. The apparatus of claim 1 wherein said arc-quenching means comprises an epoxy adhesive.

9. A blown fuse indicator to be attached to the exterior of an electric fuse comprising;

(a) a pair of spaced apart conductive terminals for attaching the indicator to a fuse;

(b) an indicator head, having a substantially flat bottom surface defining an indicator head plane;

(c) an indicator head support pin connected to the underside of said indicator head and extending away therefrom in a direction perpendicular to said indicator head plane, said pin having a slot in a portion thereof spaced from said indicator head, said slot having an edge thereof facing the underside of said indicator head; said pin having at least one laterally extending leg spaced downwardly from said slot; and a downwardly extending leg positioned below said laterally extending leg;

(d) an indicator biasing spring, one end thereof engaging said downwardly extending leg and said at least one laterally extending leg of said indicator head support pin;

(e) a body formed from an insulating material, said body comprising;

(i) an indicator head receiving recess in an upwardly facing surface thereof, said recess having a support surface for engaging said substantially flat bottom of said indicator head;

(ii) means for supporting said pair of conductive terminals in said spaced apart relationship in a plane in spaced underlying relationship with said indicator head plane;

(iii) a opening in said support surface which communicates with a chamber within said body, said chamber being defined in part by an interior wall lying in substantially the same plane as said pair of conductive terminals; said indicator support pin extending through said opening and into said chamber;

(iv) an indicator wire containing passage within said chamber extending from a location immediately adjacent one of said conductive terminals to a location immediately adjacent the other of said conductive terminals; said passageway having a region of discontinuity at a location underlying said opening in said support surface thereby dividing said passageway into two sections;

(f) an indicator restraining wire, one end of said wire being electrically conductively connected to said one of said conductive terminals at said location adjacent thereto, said wire extending through a first section of said indicator wire containing passageway to said region of discontinuity wherein said wire passes through said slot in said indicator head support pin, said wire continuing therefrom through the other of said indicator wire containing passageways to said location adjacent the other of said conductive terminals where it is electrically conductively connected to said terminal, said wire being in a taught condition, resulting in said wire engaging said edge of said slot facing said underside of said indicator head and pulling said indicator head support pin and said indicator head downwardly to compress said indicator biasing spring between said at least one laterally extending leg and said interior wall of said chamber;

(g) arc-quenching means for completely encapsulating the portions of said indicator wire contained in both of said sections of said indicator wire containing passageway.

10. The apparatus of claim 9 wherein said arc-quenching means comprises an epoxy adhesive.

11. The apparatus of claim 10 wherein said body comprises two halves, each half comprising a substantially identical molded part.

12. The apparatus of claim 11 wherein said body halves are injection molded from a glass filled polycarbonate resin.

13. An electric fuse and blown fuse indicator assembly, said fuse comprising:

(a) a casing of insulating material;

(b) a pair of terminals mounted on the axial outer ends of said casing;

(c) a fusible element inside said casing conductively interconnecting said pair of terminals;

(d) and an indicator attaching means associated with each of said terminals for electrically attaching an indicator between said terminals;

said indicator comprising:

(a) a rigid electrically insulating body;

(b) a pair of spaced apart conductive terminal means, supported by said body, for removably attaching said indicator to said indicator attaching means of said fuse.

(c) a predetermined path within said body extending from one of said conductive terminal means to the other of said conductive terminal means;

(d) an indicator restraining wire having one end electrically conductively connected to one of said conductive terminal means and being tightly drawn along said predetermined path, the other end of said wire being electrically conductively connected to the other of said conductive terminal means;

(e) a spring biased indicating means carried by said body at a location along said predetermined path of said indicator restraining wire, a section of said tightly drawn indicator restraining wire operatively engaging a portion of said indicating means and holding said indicating means in a "not blown" condition;

(f) arc-quenching means for substantially completely encapsulating substantially all of said indicator restraining wire except said section which engages a portion of said indicating means.

14. The apparatus of claim 13 wherein said arc-quenching means comprises a cured epoxy resin.

* * * * *